US008424151B2

(12) United States Patent
Lee

(10) Patent No.: US 8,424,151 B2
(45) Date of Patent: Apr. 23, 2013

(54) VACUUM CLEANER HAVING SAFETY APPARATUS OF AUXILIARY BRUSH ASSEMBLY

(75) Inventor: Byung-Jo Lee, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 265 days.

(21) Appl. No.: 12/813,756

(22) Filed: Jun. 11, 2010

(65) Prior Publication Data

US 2011/0005028 A1 Jan. 13, 2011

(30) Foreign Application Priority Data

Jul. 8, 2009 (KR) ..... 10-2009-0061971
Jul. 8, 2009 (KR) ..... 10-2009-0061972

(51) Int. Cl.
*A47L 5/00* (2006.01)

(52) U.S. Cl.
USPC ..... 15/319; 15/323; 15/334; 15/387

(58) Field of Classification Search ..... 15/246.2, 15/319, 323, 328, 334, 335, 387
See application file for complete search history.

(56) References Cited

U.S. PATENT DOCUMENTS 5,477,586 A * 12/1995 Jacobs et al. ..... 15/332
7,770,257 B2 * 8/2010 Kim ..... 15/412
7,814,614 B2 * 10/2010 Cho et al. ..... 15/383
2006/0042043 A1 3/2006 Kim
2007/0271727 A1 11/2007 Adams

FOREIGN PATENT DOCUMENTS

| | | |
|---|---|---|
| GB | 2 416 680 A | 2/2006 |
| GB | 2461614 | 1/2010 |
| JP | 07-289483 | 11/1995 |
| KR | 10-2005-0060332 | 6/2005 |
| KR | 10-0730232 | 6/2007 |

OTHER PUBLICATIONS

United Kingdom Search Report issued on Nov. 4, 2010, in corresponding United Kingdom Patent Application No. GB1011180.5 (3 pages).
Search Report issued by the United Kingdom Patent Office on Aug. 31, 2011, in counterpart United Kingdom Patent Application No. 1011180.5 (2 pages).

* cited by examiner

*Primary Examiner* — William Gilbert
*Assistant Examiner* — Patrick Maestri
(74) *Attorney, Agent, or Firm* — NSIP Law

(57) ABSTRACT

A vacuum cleaner having a safety apparatus of an auxiliary brush assembly is provided. The vacuum cleaner includes a main body having an extension pipe mounting portion, a main brush assembly connected to the main body, an extension pipe attached and detached to the main body, and an auxiliary brush assembly connected to an end of the extension pipe. The auxiliary brush assembly may have a brush and a driving means for rotating the brush, wherein the rotation of the brush may be automatically stopped when the extension pipe is mounted in the extension pipe mounting portion.

20 Claims, 8 Drawing Sheets

VACUUM CLEANER HAVING SAFETY APPARATUS OF AUXILIARY BRUSH ASSEMBLY

CROSS-REFERENCE TO RELATED APPLICATIONS

This application claims the benefit under 35 U.S.C. §119 (a) of Korean Patent Applications No. 10-2009-0061971 and No. 10-2009-0061972, both filed on Jul. 8, 2009 in the Korean Intellectual Property Office, the entire disclosure of each of which is incorporated herein by reference for all purposes.

BACKGROUND

1. Field

The following description relates to a vacuum cleaner, and more particularly, to a vacuum cleaner having a safety apparatus of an auxiliary brush assembly.

2. Description of the Related Art

An upright type vacuum cleaner may include a main brush assembly for cleaning floors and an auxiliary brush assembly for cleaning narrow spaces, steps, walls and the like.

Each of the main brush assembly and the auxiliary brush assembly may have a brush provided in the interior thereof. Here, the brush may be rotated while sweeping a surface to be cleaned so that foreign substances on the surface may be forcibly drawn into the vacuum cleaner. The brush may be rotated by a turbo fan or by a separate drive motor.

If the rotation of the brush is not stopped when cleaning is finished, the vacuum cleaner may be broken or damaged by the rotating brush, a user may be injured by the rotating brush, or the like. Therefore, it is desirable to prevent or limit the rotation of the brush after the cleaning is finished.

Accordingly, devices have been designed in which the rotation of a brush built in a main brush assembly may be controlled in a vacuum cleaner configured so that the brush is rotated using a turbo fan unit.

Korean Patent No. 0730232 provides that an amount of suction air may be adjusted using a dust inlet provided to a connector connected to a suction extension pipe, thereby controlling the rotation speed of a brush.

Also, Japanese Patent Publication No. 1995-289483 provides that the rotation of a brush may be controlled using a hole for controlling air volume and a member for opening/closing the hole.

In addition, Korean Patent No. 0528015 provides that the rotation of a brush may be controlled using a knob for air volume control.

In these devices, vacuum cleaners may be configured so that a brush is rotated using a turbine fan rotated by drawn in air, and user's accidents may be prevented or reduced by controlling the rotation of the brush using the drawn in air.

However these devices, may be configured such that an auxiliary brush assembly may be attached together with an extension pipe to a main body during storage and detached from the main body during cleaning. If the auxiliary brush assembly is attached to the main body in the state that the rotation of a brush rotated in the auxiliary brush assembly is not stopped after cleaning using the auxiliary brush assembly is finished, the surface of the vacuum cleaner may be damaged. Also, a user may be involved in an unexpected accident.

SUMMARY

In one general aspect, there is provided a vacuum cleaner including a main body having a extension pipe mounting portion, a main brush assembly connected to the main body, an extension pipe attached and detached to the main body, and an auxiliary brush assembly connected to an end of the extension pipe, the auxiliary brush assembly having a brush and a driving means for rotating the brush, wherein the rotation of the brush is automatically stopped, when the extension pipe is mounted in the extension pipe mounting portion.

The extension pipe may further include an air inlet hole and an open/close member, wherein the driving means may be a turbine fan unit rotating by a suction air current, the open/close member opens the air inlet hole when the extension pipe is mounted in the extension pipe mounting portion.

The vacuum cleaner may further include a mounting groove formed at the main body, the mounting groove allowing the auxiliary brush assembly to be mounted therein, wherein brush fixing projections for preventing the rotation of the brush are mounted in the mounting groove.

The extension pipe mounting portion may include an open/close holding portion for holding the open/close member, and an extension pipe holding portion for holding the extension pipe.

The open/close member may be formed to surround a portion of the extension pipe, and has at least one fixing projection.

The fixing projection may be formed to protrude from the open/close member, and a fixing projection holding portion having the fixing projection mounted therein may be formed at the main body, and when the extension pipe is attached to the main body, the fixing projection may be mounted in the fixing projection holding portion, and the open/close member may be moved to open the air inlet hole, so that the rotation of the brush is stopped.

The vacuum cleaner may further include a support member for fixing the extension pipe so that the extension pipe is not inadvertently detached from the main body.

The driving means may be a driving motor transmitting a rotation force to the brush, the power of the drive motor may be automatically cut off when the extension pipe is mounted to the extension pipe mounting portion.

A switch for cutting off the power of the drive motor may be provided at the extension pipe mounting portion, and the switch may be operated when the extension pipe is mounted to the extension pipe mounting portion.

The extension pipe may further include a fixing tube and fixing projections formed at the fixing tube.

The fixing projections may be protruded from the fixing tube to be symmetric to each other, and a fixing projection holding portion for holding the fixing projections may be formed at the main body, and when the extension pipe is attached to the main body, the fixing projections may operate the switch and are inserted into the main body so that the extension pipe is not detached from the main body.

The fixing tube may be formed at a position adjacent to a handle portion in the extension pipe so as to surround at least a portion of the extension pipe.

The extension pipe mounting portion may further include a support member for supporting a lower portion of the extension pipe.

An auxiliary brush assembly fixing portion having brush fixing projections may be formed at the main body.

In another aspect, there is provided a vacuum cleaner including a main body, a main brush assembly, and an extension pipe removably attached to the main body, the extension pipe including an auxiliary brush assembly connected to the end of extension pipe, the auxiliary brush assembly rotating when in use, a first mechanism configured to stop rotation of the auxiliary brush assembly, and a second mechanism configured to stop rotation of the auxiliary brush assembly.

The first mechanism configured to stop rotation of the auxiliary brush assembly may be formed on the extension pipe and the second mechanism configured to stop rotation of the auxiliary brush assembly may be formed on the main body of the vacuum cleaner.

The first mechanism configured to stop rotation of the auxiliary brush assembly may include at least one air inlet hole formed in the extension and configured to reduce a suction force to the auxiliary brush mechanism when opened.

The second mechanism configured to stop rotation of the auxiliary brush assembly may include brush fixing projections configured to be inserted into suction holes of the auxiliary brush assembly and stuck to a brush of the auxiliary brush assembly.

The first mechanism configured to stop rotation of the auxiliary brush assembly may include a drive motor for driving the auxiliary brush assembly, wherein power to the drive motor is cut upon actuation of a switch.

The second mechanism configured to stop rotation of the auxiliary brush assembly may include brush fixing projections configured to be inserted into suction holes of the auxiliary brush assembly and stuck to a brush of the auxiliary brush assembly.

Other features and aspects will be apparent from the following detailed description, the drawings, and the claims.

Figure 1:
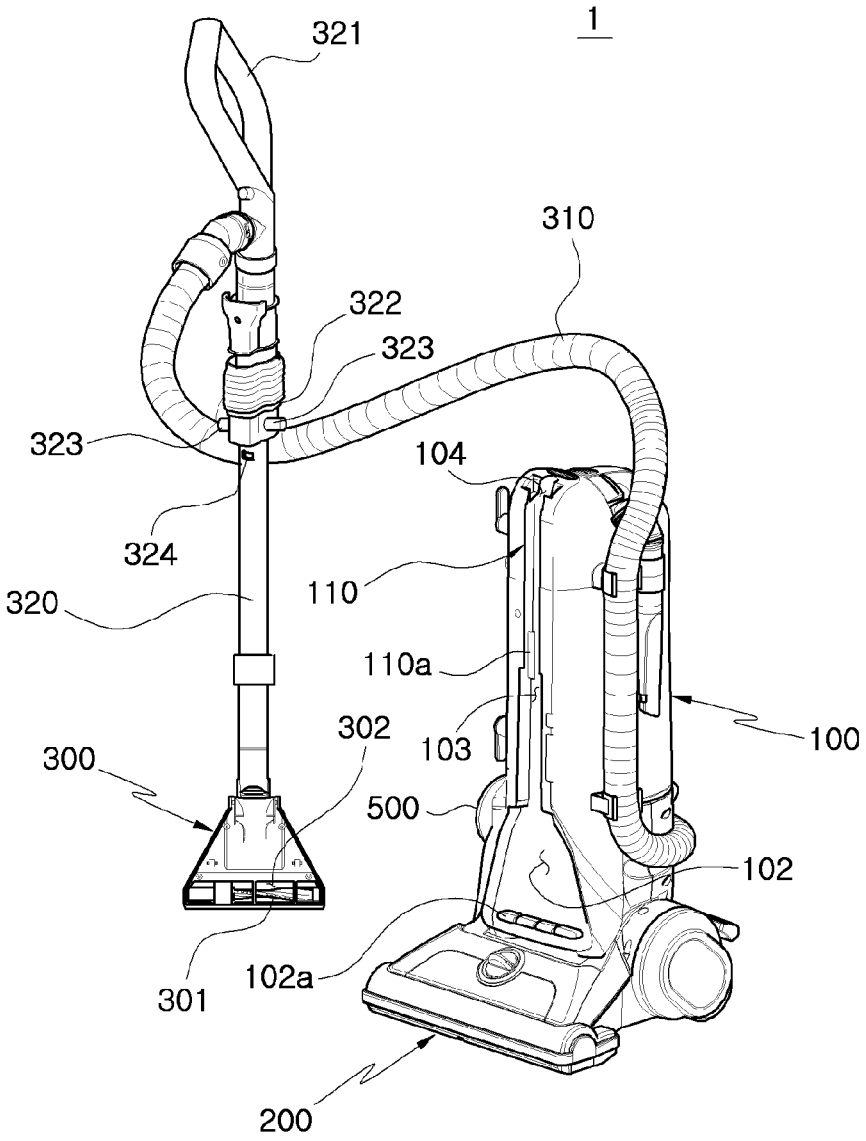
FIG. 1 is a perspective view illustrating an example of a vacuum cleaner from which an auxiliary brush assembly may be separated.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

Figure 2:
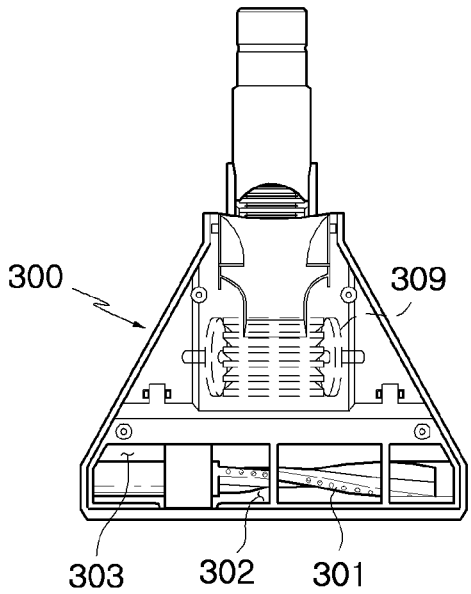
FIG. 2 is an enlarged bottom plan view illustrating an example of the auxiliary brush assembly of FIG. 1.
Figure 3:
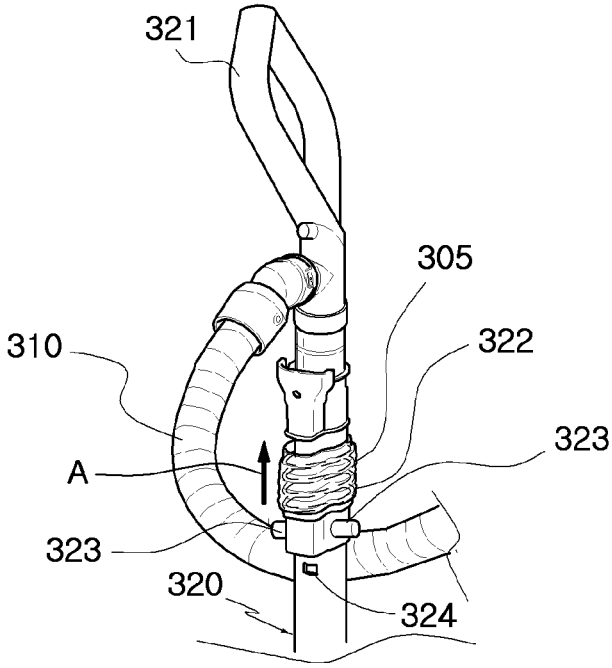
FIG. 3 is a partial perspective view illustrating an example of an extension pipe of FIG. 1 in the state that an air inlet hole is opened.
Figure 4:
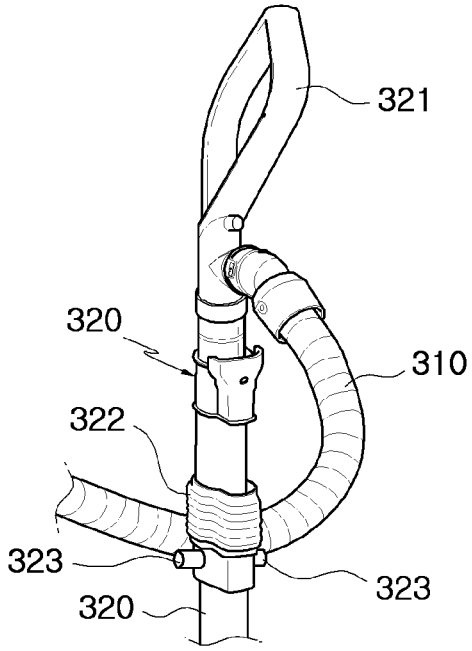
FIG. 4 is a partial perspective view illustrating an example of the extension pipe of FIG. 1 in the state that the air inlet hole is closed.
Figure 5:
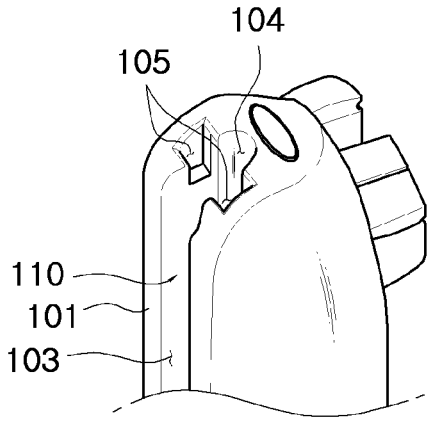
FIG. 5 is a partial perspective view illustrating an example of a front cover of FIG. 1 showing a mounting groove and an extension pipe insertion groove, formed on a front of a main body.

FIG. 1 illustrates an example of a vacuum cleaner 1 from which an auxiliary brush assembly 300 is separated. FIG. 2 illustrates an example of the auxiliary brush assembly 300. FIG. 3 illustrates an example of an extension pipe 320 in the state that an air inlet hole 324 is opened. FIG. 4 illustrates an example of the extension pipe 320 in the state that the air inlet hole 324 is closed. FIG. 5 illustrates an example of a front cover showing a mounting groove 102 and an extension pipe mounting portion 110, formed on a front of a main body 100.

By way of example, as shown FIG. 1, the vacuum cleaner 1 includes a main body 100, a main brush assembly 200, an extension pipe 320 connected to the main body 100 by a hose 310, and an auxiliary brush assembly 300.

The main brush assembly 200 may have a built-in brush (not shown) to perform cleaning of a floor surface.

The auxiliary brush assembly 300 has a turbine fan unit 309 and brush 301, formed in the interior thereof. As shown in the example depicted in FIG. 2, the auxiliary brush assembly 300 also has suction holes 302 for drawing air containing foreign substances formed at a mounting position of the brush 301, and a sprocket container 303 in which a sprocket is mounted. Here, the sprocket is axially connected to the brush so that the rotation force of the turbine fan unit 309 may be provided to the brush 301. The turbine fan unit 309 having the aforementioned structure may be rotated by air drawn through the suction holes 302 so as to rotate the brush 301.

Figure 6:
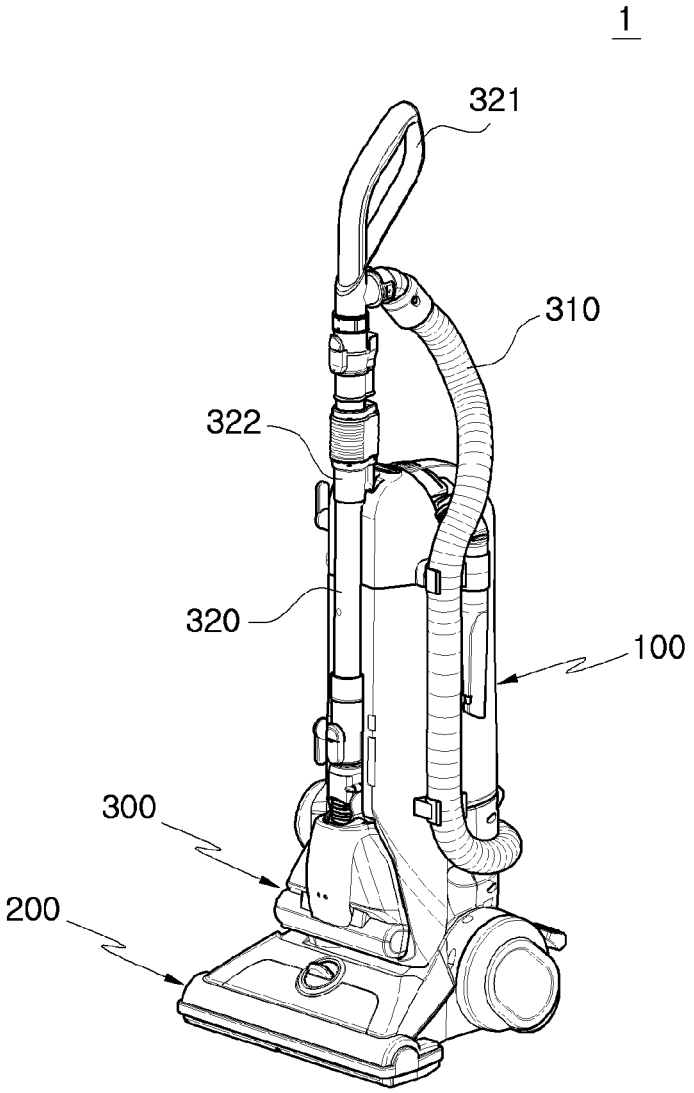
FIG. 6 is a perspective view illustrating an example of a vacuum cleaner in which an auxiliary brush assembly of FIG. 1 is mounted.

The auxiliary brush assembly 300 is configured together with the extension pipe 320 and the hose so as to be attached to and detached from the main body 100. Accordingly, when the auxiliary brush assembly 300 is used for cleaning, it may be detached together with the extension pipe 320 from the main body 100, as shown in FIG. 1, for example. When the auxiliary brush assembly 300 is not used, it may be inserted into a mounting groove 102 and fixed to the main body 100, as shown in FIG. 6, for example.

Referring to FIGS. 3 and 4, the extension pipe 320 includes a handle portion 321, an open/close member 322 and an air inlet hole 324.

The handle portion 321 has a plurality of switches (not shown) for controlling operations of the vacuum cleaner 1 including the driving of a fan motor unit (not shown) when cleaning is performed using the auxiliary brush assembly 300. The handle portion 321 is formed at an upper portion of the extension pipe 320. The switches (not shown) may be formed at the handle portion 321, at the main body 100, or at both of the handle portion 321 and the main body 100.

As shown in FIGS. 3 and 4, for the purposes of example, the open/close member 322 has fixing projections 323 protruded to be symmetric to each other at both sides thereof. The open/close member 322 is connected to the extension pipe 320 to move upward and downward from the position at which the air inlet hole 324 is formed at a lower portion of the handle portion 321. Thus, the open/close member 322 may open or close the air inlet hole 324. The open/close member 322 may have an elastic member 305 formed in the interior thereof. Here, the elastic member 305 moves the open/close member 322 to the position at which the air inlet hole 324 is closed when an external support force is not applied to the open/close member 322.

The air inlet hole 324 is formed to pass through a surface of the extension pipe 320 connected to the open/close member 322. Thus, the air inlet hole 324 allows external air to be drawn into the extension pipe 320 therethrough so that a suction force generated from the interior of the main body 100 may not be provided to the auxiliary brush assembly 300, thereby stopping or reducing the rotation of the brush 301.

A plurality of air inlet holes 324 may be formed along the longitudinal length of the extension pipe 320 so as to control the intensity of the suction force in the auxiliary brush assembly 300.

The extension pipe 320 may be a telescopic pipe formed to be extensible and contractible.

In the extension pipe 320 having the open/close member 322 and the air inlet hole 324, when it is necessary to control the suction force in the auxiliary brush assembly 300 (to lower the suction force) or when it is necessary to stop or reduce the rotation of the brush 301, the open/close member 322 may be positioned to open the air inlet hole 324 as shown in FIG. 3, for example. Accordingly, the suction force provided to the auxiliary brush assembly 300 is weakened or is not provided to the auxiliary brush assembly 300 due to the external air drawn through the air inlet hole 324, so that the rotation of the brush 301 is reduced or stopped.

When it is not necessary to control the suction force in the auxiliary brush assembly 300 or when it is not necessary to stop the rotation of the brush 301, the open/close member 322 may be positioned to close the air inlet hole 324, as shown in the example illustrated in FIG. 4.

With reference to FIG. 1, the main body 100 has a dust condensing apparatus (not shown), a fan motor unit (not shown) and a filter unit (not shown), mounted therein. The main body 100 also has the auxiliary brush assembly 300 and a flow path changing apparatus 500. Thus, the main body 100 may be inclinedly connected to an upper portion of the main brush assembly 200.

The flow path changing apparatus 500 may change a flow path to allow a suction force generated from the main body 100 to be selectively provided to the main brush assembly 200 or the auxiliary brush assembly 300.

Through such a connection, the main body 100 may be in an inclined state when cleaning is performed using the main brush assembly 200, and in an upright state when cleaning is performed using the auxiliary brush assembly 300.

Referring to the example in FIG. 1, the mounting groove 102 and an extension pipe mounting portion 110 are formed at the main body 100. Here, the mounting groove 102 may be formed at the front cover 101 of the main body 100 so as to allow the auxiliary brush assembly 300 to be attached to and detached from the main body 100 by inserting the auxiliary brush assembly 300 into the auxiliary brush assembly fixing portion 102. The extension pipe mounting portion 110 has the extension pipe 320 accommodated therein.

Brush fixing projections 102*a* are respectively formed at positions corresponding to the suction holes 302 in the mounting groove 102. When the auxiliary brush assembly 300 is mounted in the mounting groove 102, the brush fixing projections 102*a* may be respectively inserted into the suction holes 302 and stuck to the brush 301 so that the rotation of the brush 301 is stopped.

The extension pipe mounting portion 110 (see FIG. 5) has an open/close member holding portion 104 in which the open/close member 322 connected to move upward and downward is held at an upper portion of the extension pipe 320, and the extension pipe holding portion 103 in which the extension pipe 320 is insertedly mounted. A fixing projection holding portion 105 is formed to have both sides symmetric to each other in the open/close member holding portion 104.

A support member 110*a* (see FIGS. 1 and 6) for fixing the extension pipe 320 while surrounding the extension pipe 320 at an adjacent position of the mounting groove 102 is formed in the extension pipe holding portion 103 so as to prevent or deter the extension pipe 320 from being inadvertently detached from the main body 100 by the front and rear shakes of the main body 100 when the extension pipe 320 is fixedly inserted into the extension pipe holding portion 103. In FIGS. 1 and 6, the support member 110*a* is formed so that the extension pipe 320 is forcibly connected thereto. However, the support member 110*a* may be variously configured to have a member for fixing the extension pipe 320 while surrounding the extension pipe 320 using a buckle, for example, or other suitable fastening mechanism.

In the vacuum cleaner 1 having the aforementioned configuration, when a user performs cleaning using the auxiliary brush assembly 300, the extension pipe 320 and the auxiliary brush assembly 300 may be separated together from the extension pipe holding portion 103 and the mounting groove 102 of the main body 100., as shown in FIG. 1, for example.

In this case, the open/close member 322 is separated from the open/close member holding portion 104, and the fixing projections 323 are detached from the fixing projection holding portion 105 (see FIG. 3). At this time, the open/close member 322 is automatically moved to the position by the elastic member 305 mounted inside of the open/close member 322 so as to close the air inlet hole 324. Accordingly, when the fan motor unit (not shown) is driven, the generated suction force is provided to the auxiliary brush assembly 300 without loss, or with only limited loss, due to the air inlet hole 324, so that cleaning may be performed using the auxiliary brush assembly 300.

If the auxiliary brush assembly 300 is not easily moved due to an increase in the adhesive force between the auxiliary brush assembly 300 and a surface to be cleaned during the cleaning using the auxiliary brush assembly 300, a user may move the open/close member 322 to the position at which the air inlet hole 324 is opened. Accordingly, external air may be drawn through the air inlet hole 324, and therefore, the suction force may not be provided to the auxiliary brush assembly 300. Thus, the adhesive force between the surface to be cleaned and the auxiliary brush assembly 300 may be weakened due to the decrease in the suction force of the auxiliary brush assembly 300, so that it is possible to facilitate the movement of the auxiliary brush assembly 300 or to stop the rotation of the brush 301.

The size and number of air inlet holes 324 formed at the extension pipe 320 may be controlled to allow the adhesive force between the auxiliary brush assembly 300 and the surface to be cleaned (the suction force of the auxiliary brush assembly 300) to be decreased by the opening of the air inlet hole 324 or to allow the rotation of the brush 301 mounted in the auxiliary brush assembly 300 to be reduced or stopped by the opening of the air inlet hole 324.

If the cleaning using the auxiliary brush assembly 300 is finished, the user may attach the auxiliary brush assembly 300 together with the extension pipe 320 to the main body 100 and then store the vacuum cleaner 1 (see FIG. 6, for example). At this time, the bottom surface of the auxiliary brush assembly 300 is connected to the mounting groove 102, and the extension pipe 320 is insertedly connected to the extension insertion groove 110.

When the extension pipe 320 is mounted to the extension pipe mounting portion 110, the open/close member 322 may be inserted into the open/close member holding portion 104. In this case, the fixing projections 323 respectively protruded to both sides of the open/close member 322 are inserted into the fixing projection holding portion 105 to be supported, and move the open/close member 322 in the opening direction of the air inlet hole 324 (see an arrow A in FIG. 3) while the elastic member 305 is compressed, thereby opening the air inlet hole 324. Accordingly, when the auxiliary brush assembly 300 and the extension pipe 320 are fixedly connected to the main body 100, the air inlet hole 324 is opened so that the suction force may not be provided to the auxiliary brush assembly 300. Thus, the rotation of the brush 301 is automatically stopped or reduced. When the extension pipe 320 is detached from the extension pipe mounting portion 110, the elastic member 305 moves the open/close member 322 in the closing direction of air inlet hole 324, thereby closing the air inlet hole 324.

When the auxiliary brush assembly 300 is mounted in the mounting groove 102, the brush fixing projections 102*a* (see FIG. 1) are respectively inserted into the suction holes 302 (see FIG. 2) to fix the brush 301, so that it is possible to prevent or deter the brush 301 from being rotated in the state that the auxiliary brush assembly 300 is attached to the main body 100.

The fixing projections 323 are fixedly inserted into the fixing projection holding portion 105, so that it is possible to prevent or deter the extension pipe 320 from being inadvertently detached from the extension pipe holding portion 103 even when the main body 100 is shaken. In this case, a lower portion of the extension pipe 320 is fixed so that the support member 110*a* for supporting the extension pipe 320 at the lower portion adjacent to the mounting groove 102 of the extension pipe 320 may not be detached from the extension pipe holding portion 103. Accordingly, it is also possible to prevent or deter the auxiliary brush assembly 300 and the extension pipe 320 from being inadvertently detached from the mounting groove 102 and the extension pipe holding portion 103.

The structure and operation of the vacuum cleaner 2 according to embodiment second example are explained below with reference to the examples shown in FIGS. 7 to 11.

Figure 7:
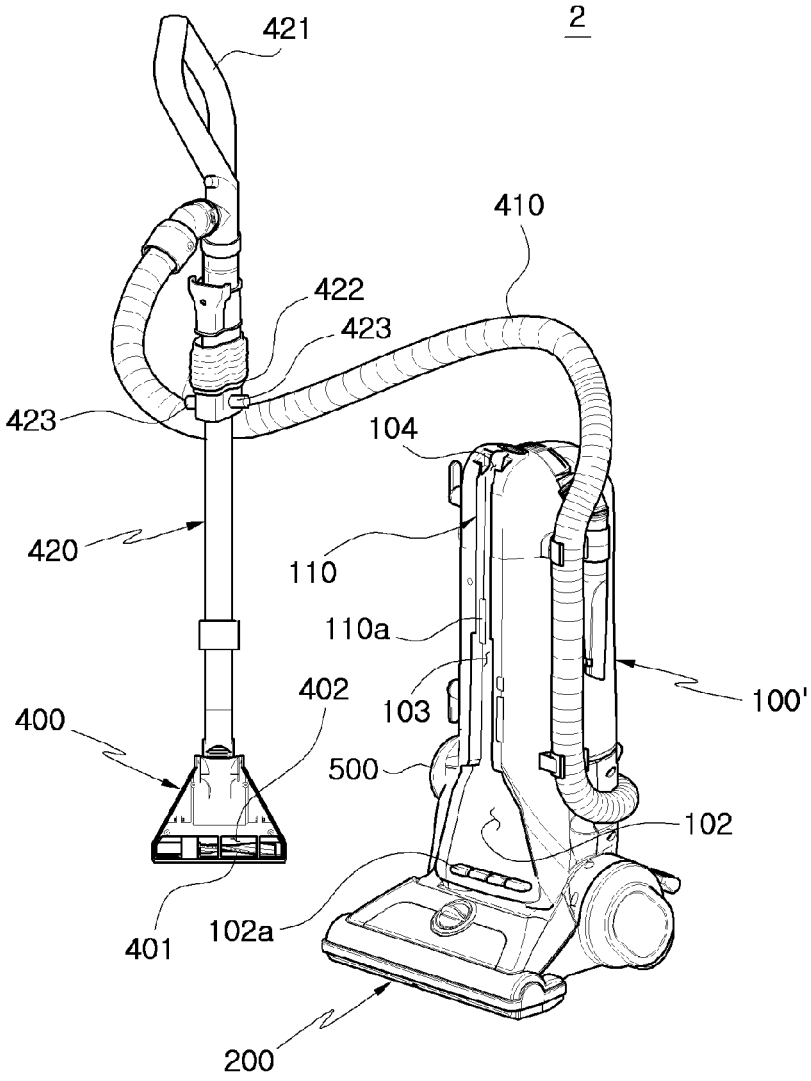
FIG. 7 is a perspective view illustrating an example of a vacuum cleaner from which an auxiliary brush assembly is separated according to a second example.
Figure 8:
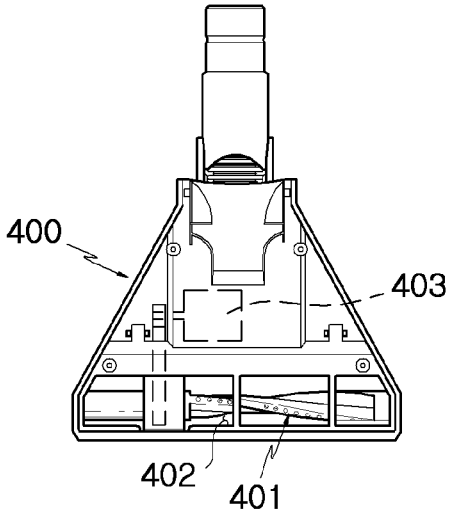
FIG. 8 is a bottom plan view illustrating an example of the auxiliary brush assembly of FIG. 7.
Figure 9:
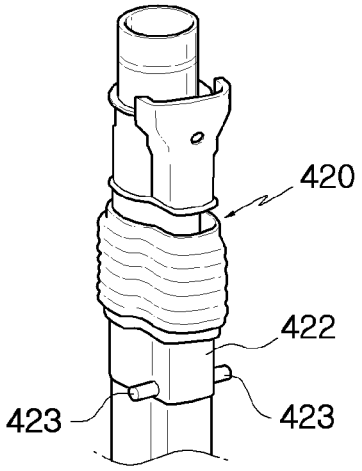
FIG. 9 is a perspective view illustrating an example of the state that an extension pipe and a fixing tube of FIG. 7 are connected to each other.
Figure 10:
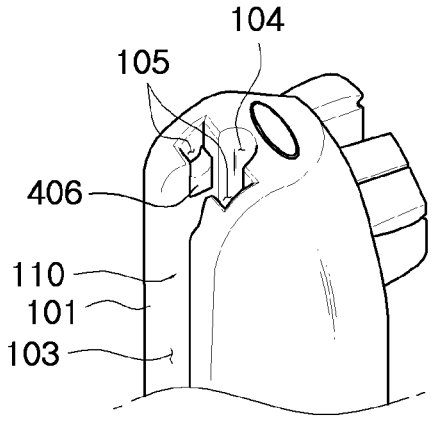
FIG. 10 is a partial perspective view illustrating an example of a front cover of FIG. 7 showing an extension pipe fixing portion formed on a front of a main body.
Figure 11:
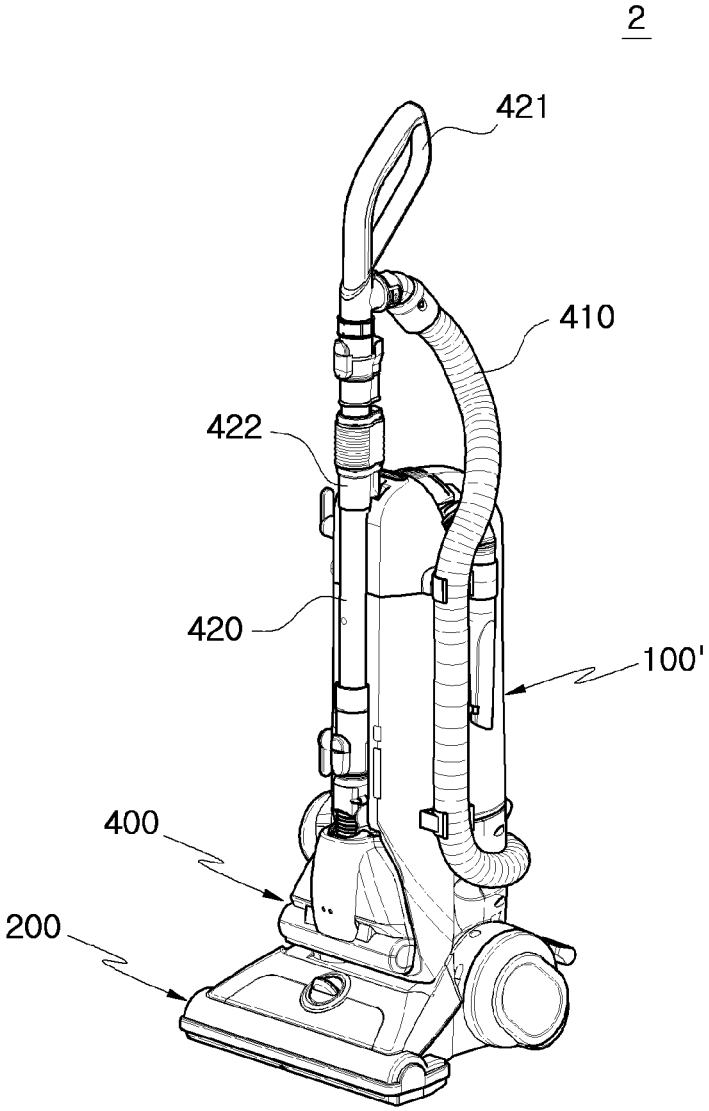
FIG. 11 is a perspective view illustrating an example of the vacuum cleaner to which the auxiliary brush assembly of FIG. 7 is attached.

FIG. 7 illustrates an example of a vacuum cleaner 2 from which an auxiliary brush assembly 400 is separated. FIG. 8 illustrates an example of the auxiliary brush assembly 400. FIG. 9 illustrates an example of the state that an extension pipe 420 and a fixing tube 422 are connected to each other. FIG. 10 illustrates an example of a front cover 101 showing an extension pipe mounting portion 110 formed on a front of a main body 100'. FIG. 11 illustrates an example of the vacuum cleaner 2 to which the auxiliary brush assembly 400 is attached.

Referring to the example shown FIG. 7, the vacuum cleaner 2 includes a main body 100', a main brush assembly 200, an extension pipe 420 connected to the main body 100' by a hose 410, and an auxiliary brush assembly 400.

The main brush assembly 200 may have a built-in brush (not shown) to perform cleaning of a floor surface.

Referring to the example shown in FIG. 8, the auxiliary brush assembly 400 has a drive motor 403 and a brush 401, mounted in the interior thereof, and suction holes 402 for drawing in air containing foreign substances, such as dusts, are formed at a mounting position of the brush 401.

The auxiliary brush assembly 400 having the aforementioned structure may be configured together with the extension pipe 420 and the hose so as to be attached to and detached from the main body 100'. Accordingly, when the auxiliary brush assembly 400 is used for cleaning, it may be detached together with the extension pipe 420 from the main body 100'. When the auxiliary brush assembly 400 is not used, the extension pipe 420 and the hose 410 may not be detached from the main body 100' but respectively inserted into an extension pipe holding portion 103 and an auxiliary brush assembly fixing portion 102, as shown in FIG. 11, for example. Thus, the extension pipe 420 and the hose 410 may be fixed to the main body 100'.

A handle portion 421 having a plurality of switches (not shown) is formed at an upper portion of the extension pipe 420. Here, the plurality of switches may control operations of the vacuum cleaner 2 and the auxiliary brush assembly 400 when cleaning is performed using the auxiliary brush assembly 400. A switch (not show) is also formed at the handle portion 421. Here, the switch controls the drive motor 403 for rotating the brush 401 provided to the auxiliary brush assembly 400. In this case, the switch for driving the drive motor 403 may be integrally formed with a switch (not shown) for driving a fan motor unit (not shown) mounted in the main body 100' so that the drive motor 403 is also driven when the fan motor unit is driven. The switch for driving the fan motor unit may be formed at the handle portion 421, the main body 100', or both the handle portion 421 and the main body 100'.

A fixing tube 422 is fixed while surrounding the extension pipe 420 at a lower portion of the handle portion of the extension pipe 420. Here, the fixing tube 422 has fixing projections 423 respectively protruded to both sides thereof.

A power line (not shown) is wired in the interior of the extension pipe 420 and the hose 410. Here, the power line connects a switch 406 and the drive motor 403 to each other so that power is supplied to the drive motor 403 mounted in the auxiliary brush assembly 400 to rotate the brush 401 (see FIG. 8, for example).

The extension pipe 420 may be a telescopic pipe formed to be extensible and contractible.

The main body 100' has a dust condensing apparatus (not shown), the fan motor unit (not shown) and a filter unit (not shown), mounted therein. The main body 100' also has the auxiliary brush assembly 400 and a flow path changing apparatus 500 as shown in FIG. 7, for example. Thus, the main body 100' may be connected to an upper portion of the main brush assembly 200.

The flow path changing apparatus 500 changes a flow path to allow a suction force generated from the main body 100' to be selectively provided to the main brush assembly 200 or the auxiliary brush assembly 400.

Through such a connection, the main body 100' may be in an inclined state when cleaning is performed using the main brush assembly 200, and may be in an upright state when cleaning is performed using the auxiliary brush assembly 400.

Referring to FIG. 7, the auxiliary brush assembly fixing portion 102, an extension pipe mounting portion 110 and the switch (not shown) are formed at the main body 100'. Here, the auxiliary brush assembly fixing portion 102 may be formed at the front cover 101 of the main body 100' so as to allow the auxiliary brush assembly 400 to be attached to and detached from the main body 100' by inserting the auxiliary brush assembly 400 into the auxiliary brush assembly fixing portion 102. The extension pipe mounting portion 110 has the extension pipe 420 accommodated therein, and the switch (not shown) controls the fan motor unit (not shown) mounted in the main body 100'. Brush fixing projections 102*a* are respectively formed at positions corresponding to the suction holes 402 in the auxiliary brush assembly fixing portion 102. When the auxiliary brush assembly 400 is mounted in the auxiliary brush assembly fixing portion 102, the brush fixing projections 102*a* are respectively inserted into the suction holes 402 and stuck to the brush 401 so that the rotation of the brush 401 is stopped or deterred.

The extension pipe mounting portion 110 has a fixing tube holding portion 104 in which the fixing tube 422 connected to an upper portion of the extension pipe 320 may be held, and the extension pipe holding portion 103 in which the extension pipe 420 is mounted.

A fixing projection holding portion 105 may be formed to have both sides symmetric to each other in the fixing tube holding portion 104. The switch 406 may be formed at a lower surface of the fixing projection holding portion 105.

In the example of FIG. 10, the fixing tube holding portion 104 is shown as a concave portion into which the fixing tube 422 is inserted. However, the fixing tube holding portion 104 may be configured to have various shapes of a fixing sphere for fixing the fixing tube 422.

A support member 110*a* (see FIGS. 7 and 11, for example) for fixing the extension pipe 420 while surrounding the extension pipe 420 at an adjacent position of the auxiliary brush assembly fixing portion 102 is formed in the extension pipe holding portion 103 so as to prevent or deter the extension pipe 420 from being in advertently detached from the main body 100' by the front and rear shakes of the main body 100' when the extension pipe 420 is fixedly inserted into the extension pipe holding portion 103. The support member 110*a* is formed so that the extension pipe 420 is forcibly connected thereto. However, the support member 110*a* may be variously configured to have a member for fixing the extension pipe 420 while surrounding the extension pipe 420 using a buckle, or other suitable fastening mechanism.

In the vacuum cleaner 2 having the aforementioned configuration, when a user performs cleaning using the auxiliary brush assembly 400, the extension pipe 420 and the auxiliary brush assembly 400 may be separated together from the extension pipe holding portion 103 and the auxiliary brush assembly fixing portion 102 of the main body 100', as shown in FIG. 7, for example.

At this time, the fixing tube 422 may be separated from the fixing tube holding portion 104, and the fixing projections 423 are detached from the fixing projection holding portion 105 (see FIG. 9), so that the press of the switch 406 (see FIG. 9) is released. If the press of the switch 406 is released, it is in an "on" state so that power is supplied to the drive motor 403. Accordingly, the drive motor 403 is driven to rotate the brush 401.

If the cleaning using the auxiliary brush assembly 400 is finished, the user attaches the auxiliary brush assembly 400 together with the extension pipe 420 to the main body 100' and then stores the vacuum cleaner 2. At this time, the bottom surface of the auxiliary brush assembly 400 may be connected to the auxiliary brush assembly fixing portion 102, and the extension pipe 420 may be connected to the extension pipe mounting portion 110. In this case, the brush fixing projections 102*a* are respectively inserted into the suction holes 402 to fix the brush 401. Accordingly, the rotation of the brush 410 is stopped or limited.

When the extension pipe 420 is connected to the extension pipe mounting portion 110, the fixing tube 422 is inserted into the fixing tube holding portion 104, and the fixing projections 423 respectively formed to protrude at both side of the fixing tube 422 are inserted into the fixing projection holding portion 105. In this case, the switch 406 is switched by the fixing projections 423 so as to cut off the power supplied to the drive motor 403 for driving the brush 401. Accordingly, when the auxiliary brush assembly 400 and the extension pipe 420 are fixedly connected to the main body, the rotation of the brush 401 is automatically stopped or reduced by the brush fixing projections 102*a* and the fixing projections 423 for turning off the switch 406.

The fixing projections 423 are fixedly inserted into the fixing projection holding portion 105, so that it is possible to prevent or deter the extension pipe 420 from being inadvertently detached from the extension pipe holding portion 103 even when the main body 100' is shaken. In this case, a lower portion of the extension pipe 420 is fixed so that the support member 110*a* for supporting the extension pipe 420 at the lower portion adjacent to the auxiliary brush assembly fixing portion 102 of the extension pipe 420 may not be inadvertently detached from the extension pipe holding portion 103. Accordingly, it is also possible to prevent or deter the auxiliary brush assembly 400 and the extension pipe 420 from being inadvertently detached from the auxiliary brush assembly fixing portion 102 and the extension pipe holding portion 103.

As described above, if the auxiliary brush assembly is attached to the main body after the use of the auxiliary brush assembly, the rotation of the brush mounted in the auxiliary brush assembly is automatically stopped or reduced, so that it is possible to prevent or limit power waste and safety accidents such as damage of the vacuum cleaner and user's injury, which may be caused by the undesired rotation of the brush.

Also, when cleaning is performed using the main brush assembly in the state that the auxiliary brush assembly is attached to the main body, the auxiliary brush assembly may be firmly supported, thereby facilitating the cleaning.

Also, the extension pipe and the auxiliary brush assembly may be integrally formed together to be attachable to and detachable from the main body, thereby facilitating the use of the vacuum cleaner.

Also, when cleaning is performed using the auxiliary brush assembly, the suction force provided to the auxiliary brush assembly and the rotation speed of the brush are easily controlled, thereby facilitating the cleaning.

As described above, there is provided a vacuum cleaner having a safety apparatus of an auxiliary brush assembly, in which the auxiliary brush assembly may be conveniently attached to and detached to a main body, and stability may be secured in the use of the auxiliary brush assembly.

There is also provided a vacuum cleaner having a safety apparatus of an auxiliary brush assembly, in which when an extension pipe and the auxiliary brush assembly are attached to a main body of the vacuum cleaner, they may be firmly supported to the main body even when the main body is shaken.

A number of examples have been described above. Nevertheless, it will be understood that various modifications may be made. For example, suitable results may be achieved if the described techniques are performed in a different order and/or if components in a described system, architecture, device, apparatus or circuit are combined in a different manner and/or replaced or supplemented by other components or their equivalents. Accordingly, other implementations are within the scope of the following claims.

What is claimed is:

1. A vacuum cleaner, comprising:

a main body comprising an extension pipe mounting portion;

a main brush assembly connected to the main body;

an extension pipe removably attached to the main body; and an auxiliary brush assembly connected to an end of the extension pipe, the auxiliary brush assembly comprising a brush and a driving means for rotating the brush, wherein the extension pipe is configured to automatically stop the rotation auxiliary of the brush when the extension pipe is mounted in the extension pipe mounting portion.

2. The vacuum cleaner of claim 1, wherein the extension pipe further comprises:

an air inlet hole; and an open/close member, wherein the driving means comprises a turbine fan unit configured to rotate by a suction air current, and wherein the open/close member is configured to open the air inlet hole when the extension pipe is mounted in the extension pipe mounting portion.

3. The vacuum cleaner of claim 2, further comprising a mounting groove formed at the main body, the mounting groove configured to allow the auxiliary brush assembly to be mounted therein, wherein brush fixing projections for preventing the rotation of the brush are mounted in the mounting groove.

4. The vacuum cleaner of claim 2, wherein the extension pipe mounting portion comprises:

an open/close holding portion configured to hold the open/close member; and an extension pipe holding portion for holding the extension pipe.

5. The vacuum cleaner of claim 2, wherein the open/close member is formed to surround a portion of the extension pipe, and comprises at least one fixing projection.

6. The vacuum cleaner of claim 5, wherein:

the fixing projection is formed to protrude from the open/close member;

a fixing projection holding portion comprising the fixing projection mounted therein is formed at the main body; and when the extension pipe is attached to the main body:

the fixing projection is mounted in the fixing projection holding portion, and the open/close member is moved to open the air inlet hole, so that the rotation of the brush is stopped.

7. The vacuum cleaner of claim 2, further comprising a support member configured to fix the extension pipe such that the extension pipe is not inadvertently detached from the main body.

8. The vacuum cleaner of claim 1, wherein:

the driving means comprises a driving motor transmitting a rotation force to the brush; and the power of the drive motor is configured to be automatically cut off when the extension pipe is mounted to the extension pipe mounting portion.

9. The vacuum cleaner of claim 8, wherein:

a switch configured to cut off the power of the drive motor is provided at the extension pipe mounting portion; and the switch is configured to be operated when the extension pipe is mounted to the extension pipe mounting portion.

10. The vacuum cleaner of claim 8, wherein the extension pipe further comprises:

a fixing tube; and fixing projections formed at the fixing tube.

11. The vacuum cleaner of claim 10, wherein:

the fixing projections are protruded from the fixing tube to be symmetric to each other;

a fixing projection holding portion configured to hold the fixing projections is formed at the main body; and when the extension pipe is attached to the main body, the fixing projections are configured to:

operate the switch; and be inserted into the main body such that the extension pipe is not detached from the main body.

12. The vacuum cleaner of claim 11, wherein the fixing tube is formed at a position adjacent to a handle portion in the extension pipe so as to surround at least a portion of the extension pipe.

13. The vacuum cleaner of claim 8, the extension pipe mounting portion further comprises a support member configured to support a lower portion of the extension pipe.

14. The vacuum cleaner of claim 8, wherein an auxiliary brush assembly fixing portion comprising brush fixing projections is formed at the main body.

15. A vacuum cleaner, comprising:

a main body;

a main brush assembly; and an extension pipe removably attached to the main body, the extension pipe comprising an auxiliary brush assembly connected to the end of extension pipe, the auxiliary brush assembly configured to rotate when in use;

a first mechanism configured to stop rotation of the auxiliary brush assembly; and a second mechanism configured to stop rotation of the auxiliary brush assembly.

16. The vacuum cleaner of claim 15, wherein:

the first mechanism configured to stop rotation of the auxiliary brush assembly is formed on the extension pipe; and the second mechanism configured to stop rotation of the auxiliary brush assembly is formed on the main body of the vacuum cleaner.

17. The vacuum cleaner of claim 16, wherein the first mechanism configured to stop rotation of the auxiliary brush assembly comprises at least one air inlet hole formed in the extension and configured to reduce a suction force to the auxiliary brush mechanism when opened.

18. The vacuum cleaner of claim 17, wherein the second mechanism configured to stop rotation of the auxiliary brush assembly comprises brush fixing projections configured to be inserted into suction holes of the auxiliary brush assembly, the brush fixing projections being stuck to a brush of the auxiliary brush assembly.

19. The vacuum cleaner of claim 15, wherein the first mechanism configured to stop rotation of the auxiliary brush assembly comprises a drive motor configured to drive the auxiliary brush assembly, power to the drive motor being configured to be cut upon actuation of a switch.

20. The vacuum cleaner of claim 19, wherein the second mechanism configured to stop rotation of the auxiliary brush assembly comprises brush fixing projections configured to be inserted into suction holes of the auxiliary brush assembly, the brush fixing projections being stuck to a brush of the auxiliary brush assembly.

* * * * *